US006848954B2

(12) United States Patent
Bischoff et al.

(10) Patent No.: US 6,848,954 B2
(45) Date of Patent: Feb. 1, 2005

(54) ELECTRICAL CONTACT ELEMENT

(75) Inventors: Daniel Bischoff, Buettelborn (DE); Juergen Hass, Erzhausen (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/758,785

(22) Filed: Jan. 16, 2004

(65) Prior Publication Data

US 2004/0192122 A1 Sep. 30, 2004

(30) Foreign Application Priority Data

Jan. 20, 2003 (EP) ..... 03001128

(51) Int. Cl.[7] ..... H01R 11/22
(52) U.S. Cl. ..... 439/851; 439/855
(58) Field of Search ..... 439/851, 852, 439/853, 855, 858

(56) References Cited

U.S. PATENT DOCUMENTS 3,380,012 A 4/1968 Moulin
3,573,718 A 4/1971 Lightner
4,778,404 A 10/1988 Pass
5,082,462 A 1/1992 Oswald, Jr.
5,667,413 A * 9/1997 Trafton ..... 439/843
5,775,960 A * 7/1998 Saito et al. ..... 439/843
5,921,822 A * 7/1999 Kennedy et al. ..... 439/851
6,520,811 B2 * 2/2003 Mitani et al. ..... 439/852
6,629,865 B2 * 10/2003 Bungo ..... 439/852

FOREIGN PATENT DOCUMENTS

WO WO 02/091523 A1 11/2002

* cited by examiner

*Primary Examiner*—Thanh-Tam Le
(74) *Attorney, Agent, or Firm*—Barley Snyder

(57) ABSTRACT

A single-piece electrical contact element is provided, having a substantially cylindrical contact tube for resiliently receiving a contact pin. A contact tube main part extends over a substantial part of the contact tube length and a first circumferential sub-region of the contact tube circumference. At least one radially resilient spring arm, connected to one circumferential end of the contact tube main part extends over a second circumferential sub-region of the contact tube circumference. The spring arm projects radially outwardly in a first circumferential region adjacent to the contact tube main part and has a cylindrical free-standing circumferential end region.

22 Claims, 7 Drawing Sheets

ELECTRICAL CONTACT ELEMENT

FIELD OF THE INVENTION

The invention relates to a single-piece electrical contact element having a contact tube for receiving a contact pin. The invention moreover relates to a connector arrangement having a contact housing and at least one such contact element disposed therein, as well as to a method of manufacturing a connector arrangement.

BACKGROUND OF THE INVENTION

There are applications where a tubular contact element for receiving a contact pin is required, which contact element is capable of withstanding many plug-in connection operations and tolerates frequent insertion direction movements and/or tilting movements of the inserted contact pin, which are caused for example by vibrations in the surrounding area of the contact pin, without resulting in damage or premature wear of the tubular contact element. One exemplary application that demands such a tubular contact element is for minicontacts having dimensions in the millimetre range. The contact element may also be provided for an electrical connection of an electric magnet coil wire, and the contact housing may be part of a magnet coil arrangement.

In U.S. Pat. No. 4,778,404 an oblong, resiliently compliant tubular electrical contact is provided, which is integrally punched and formed from sheet metal and has on one axial end a location region for a pin contact, on the opposite axial end a wire connection region and, in between, a resilient region. This tubular contact is accommodated in a housing chamber that allows a resilient movement only in axial direction.

In U.S. Pat. No. 3,380,012 an electrical jack is provided, comprising a location region for a pin contact as well as a cylindrical rotatable region, the periphery of which is provided with a plurality of spiral slots, so that this region is rotatable about the longitudinal axis of the contact pin. The inserting of the contact pin into the jack leads to a rotation of the rotatable region and consequently to a wiping movement between the jack and the pin contact. Such a wiping movement, while being desired in the case of the contact of U.S. Pat. No. 3,380,012, is detrimental to an application requiring many plug-ins and multidirectional movements of the inserted contact pin.

In U.S. Pat. No. 3,573,718 an electrical contact comprises a location region, which is designed to receive a pin contact and is provided with a number of spring elements enabling resiliently compliant accommodation of the pin contact. This contact has a strip-shaped projection, which enables easy insertion of the contact into a connector housing and supports the contact inserted into the connector housing. After insertion of the pin contact into the contact there is no longer any room for a resilient movement of the spring elements.

An object of the invention is to provide an electrical contact element, in particular a tubular contact element of small dimensions, which is suitable for withstanding many plug-in connection operations and tolerates frequent insertion direction movements and/or tilting movements of the inserted contact pin, as well as a connector arrangement having such a contact element and a method suitable for its manufacture.

SUMMARY OF THE INVENTION

According to an exemplary embodiment of the invention, a single-piece electrical contact element (13) is provided having a substantially cylindrical contact tube (15) for resiliently receiving a substantially cylindrical contact pin (17), the contact tube comprising a contact tube main part (19), extending over at least a substantial part of the contact tube length and over a first circumferential sub-region (21) of the contact tube circumference, and at least one radially resilient spring arm (23, 27),connected to one circumferential end of the contact tube main part (19) and extending over a second circumferential sub-region (35, 37) of the contact tube circumference. The spring arm (23, 27) projects radially outwardly in a first circumferential region (43, 45) adjacent to the contact tube main part (19) and has a cylindrical free-standing circumferential end region (47, 49). Whereby, the contact pin (17) inserted into the contact tube (15) only contacts the contact tube (15) at a first contact touch zone (51) at the contact tube main part (19) and at a second contact touch zone (53) at the free-standing end region (47, 49) of the spring arm (23, 27).

By virtue of the fact that the spring arm is formed in its region adjacent to the contact sleeve main part so as to project radially outwards from the cylindrical basic shape and only return to the cylindrical basic shape in the end region, the spring arm embraces a contact pin, which is inserted into the contact tube, over a substantial part of its circumferential length before it contacts the contact pin. This makes the spring arm in its interaction with the contact pin more resilient than if the spring arm were to lie over its entire circumferential length against the contact pin and renders the contact tube serviceable over a long lifetime. When the contact tube is inserted into a cylindrical location chamber of a connector housing that has an inside diameter corresponding to the distance of the first region of the spring arm from the contact tube longitudinal axis, a contact pin inserted into the contact tube is indeed, owing to the two touch zones in contact with the contact tube, reliably and effectively contacted by the contact tube, but the contact pin is able to effect tilting movements at right angles to the longitudinal axis of the contact tube, for example owing to vibrations acting upon the contact pin, without losing its secure mounting in the contact tube and its effective electrical contact with the contact tube.

Because of the secure resilient seating of the contact pin in the contact tube, no substantial relative movement arises between the contact tube and the contact pin even if the contact pin is subject to tilting movements because of the use of the connector arrangement comprising contact tube and pin contact in a vibration-prone environment, for example in the automobile sector, in washing machines, in portable CD players or in similar areas of application.

The invention moreover provides a method of manufacturing a connector arrangement, which comprises at least one contact element having a contact region and a mounting region, a multi-part contact housing, which receives the contact element and comprises a contact carrier holding the contact element as well as a chamber block having at least one location chamber for receiving the contact region of the at least one contact element, and an extruded encapsulation part surrounding the contact housing.

BRIEF DESCRIPTION OF THE DRAWINGS

Exemplary embodiments of the present invention are provided below with reference to the accompanying drawings, in which.

It should be understood that the individual figures of the drawings are not drawn to scale.

DETAILED DESCRIPTION OF THE INVENTION

A first exemplary embodiment of a contact element according to the invention is shown in FIGS. 1 to 4.

Figure 1:
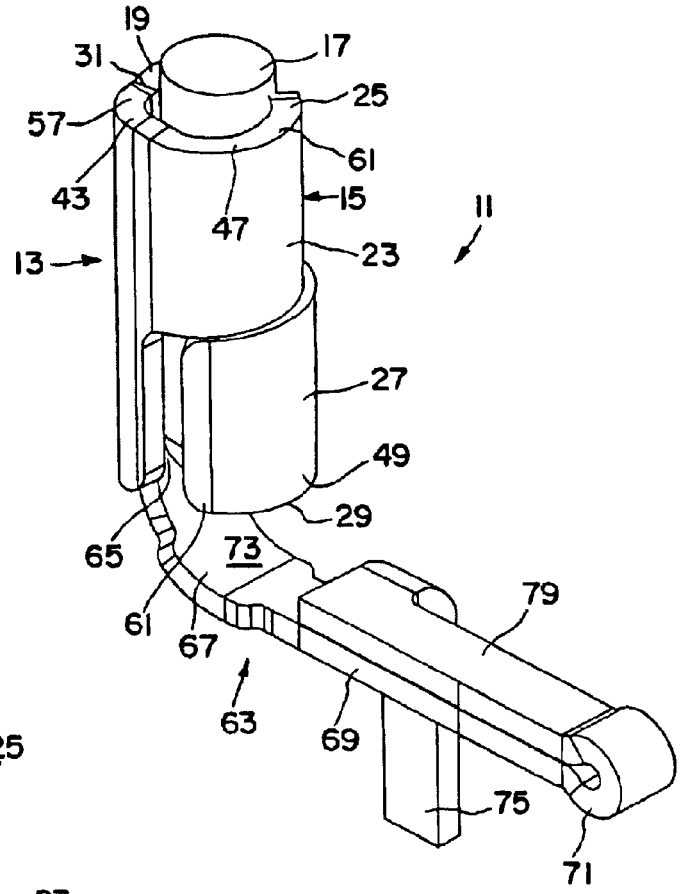
FIG. 1 is a perspective view of a contact arrangement with a contact element according to an exemplary embodiment of the invention and with a contact pin inserted into the contact tube thereof.
Figure 2:
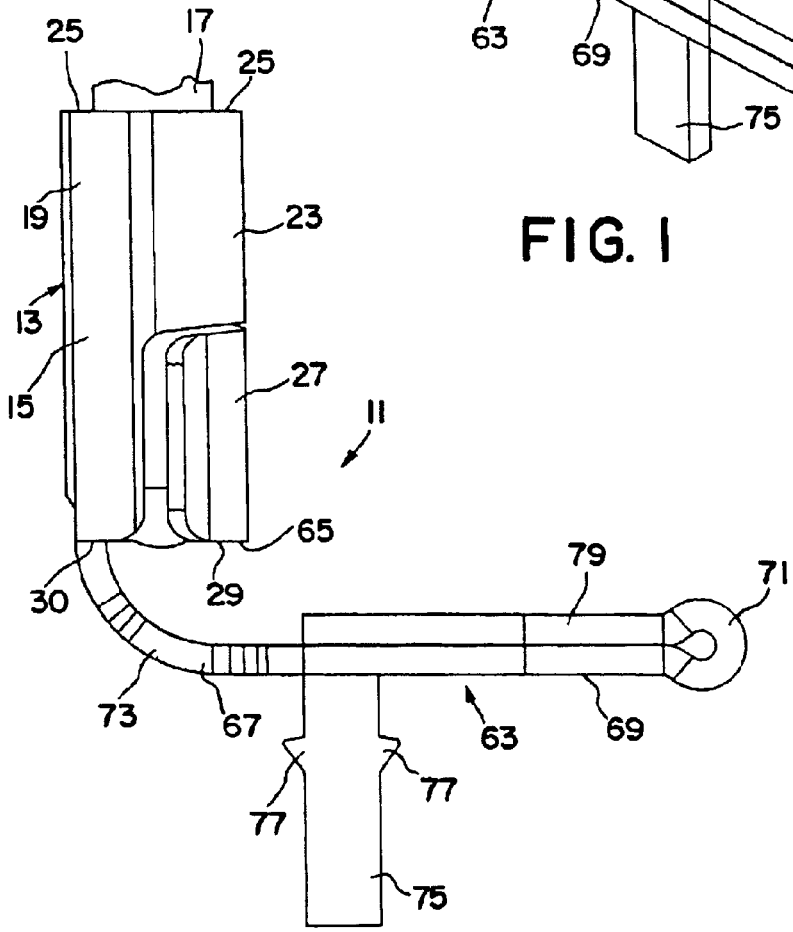
FIG. 2 is a side view of the contact arrangement of FIG. 1.
Figure 3:
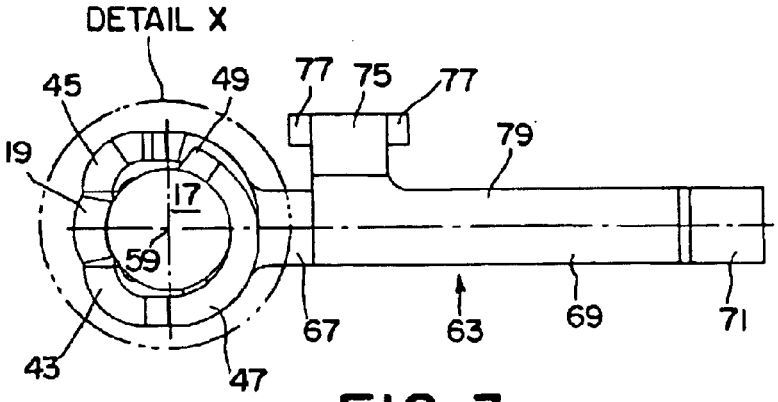
FIG. 3 is a plan view of the contact arrangement of FIG. 1.

FIG. 1 shows, in a perspective view, a contact arrangement 11 with a first exemplary embodiment of a contact element 13 according to the invention and with a contact pin 17 inserted into the contact tube 15 thereof.

The contact element 13 is a single-piece electrical contact element comprising a contact tube 15 made of a resilient material with a substantially cylindrical basic shape and radial resilience for resiliently receiving a substantially cylindrical contact pin 17. The contact tube 15 has a contact tube main part 19, which extends over at least a substantial part of the contact tube length and over a first circumferential sub-region 21 of the contact tube circumference. In the embodiments illustrated in the drawings, the contact tube 15 has two radially resilient spring arms 23, 27 disposed successively in axial direction of the contact tube 15 and movable independently of one another. The spring arms, as shown in FIG. 1 are a mating-side spring arm 23, which is situated at the mating side 25 of the contact tube 15 from which the contact pin 17 is inserted into the contact tube 15, and a terminal-side spring arm 27, which is situated at the terminal side 29 of the contact tube 15 remote from the mating side 25. Both spring arms 23 and 27 extend in each case over a part of the contact tube length, are connected to various circumferential ends of the contact tube main part 19, namely to a first circumferential end 31 and a second circumferential end 33 respectively, and extend in various circumferential directions over a second circumferential sub-region 35 and 37 respectively of the contact tube circumference. The mating-side end 25 and a stop shoulder 30 (shown in FIG. 2) at the axial end of the contact tube main part 19 remote from the mating side 25 interact with housing stops (not shown) in a manner to be described below.

Figure 4:
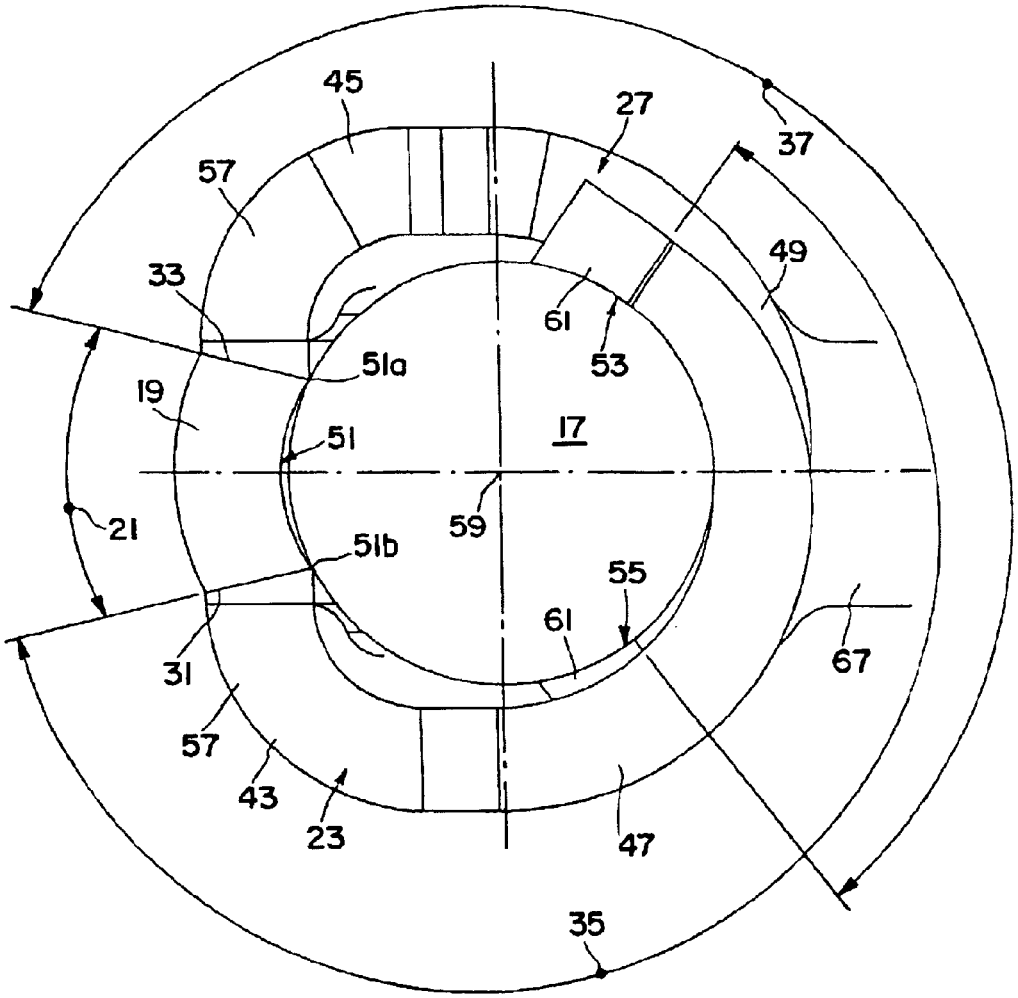
FIG. 4 is an enlarged view of a detail denoted by "X" in FIG. 3.

As shown in FIG. 4, the two spring arms 23 and 27 are each formed, in a first region 43 and 45, respectively adjacent to the contact tube main part 19, to project radially outwards from the cylindrical basic shape and, in a free-standing end region 47 and 49 respectively, to return to the cylindrical basic shape, such that between the contact tube 15 and the contact pin 17 inserted into the contact tube 15 there are three contact touch zones, namely a first contact touch zone 51 in the region of the contact tube main part 19, a second, resilient contact touch zone 53 in the free-standing end region 47 of the mating-side spring arm 23 and a third, resilient contact touch zone 55 in the free-standing end region 49 of the terminal-side spring arm 27. The second circumferential sub-regions 35 and 37 of the contact tube 15 are much larger than the first circumferential sub-region 21 thereof. In a practical embodiment of the contact element 13 according to the invention, the region of the spring arm 23 and/or 27 provided for the resilient second contact touch zone 53 and/or third contact touch zone 55 is at a circumferential distance from the contact tube main part 19 corresponding to approximately ⅔ of the contact tube circumference.

In the exemplary embodiment of the contact element 13 illustrated in FIG. 1, the first regions 43 and 45 of both spring arms 23 and 27 extend over the entire axial length of the contact tube main part 19 and only the free-standing end regions 47 and 49 of the two spring arms 23 and 27 have axial lengths that amount to only a part of the axial length of the contact tube main part 19.

As best seen in FIG. 4, the two spring arms 23 and 27 each have an approximately spiral cross-sectional shape, wherein a spiral start 57 adjacent to the contact tube main part 19 is offset radially outwards from the cylindrical basic shape so as to be at a greater radial distance from the contact tube longitudinal axis 59 than a free-standing spiral end 61. In this embodiment, the centre of curvature of the spiral start 57 is offset radially outwards relative to the longitudinal axis 59 of the cylindrical basic shape of the contact tube 15 and to the longitudinal axis of a contact pin 17 inserted into the contact tube.

As shown in FIG. 1, the contact element 13 has a connecting arm 63 integrally connected to the contact tube 15. The connecting arm 63 is connected to an end region 65 of the contact tube main part 19 remote from the mating side 25 of the contact tube 15 and is configured to enable an axial resilient movement of the contact tube 15. The connecting arm 63 comprises a resilient region 67 adjacent to the contact tube main part 19 as well as a rigid region 69 adjoining the resilient region 67. The term, rigid region, is however not intended to mean that the rigid region 69 is absolutely rigid but merely that the rigid region 69 is substantially more rigid or far less resilient than the resilient region 67.

In the exemplary embodiment illustrated in FIG. 1, the connecting arm 63 is formed by a metal strip, the resilient region 67 of which is formed by a single-layer portion of the metal strip and the rigid region 69 of which is formed by a two-layer portion of the metal strip. The rigid region 69 may be formed, for example, by folding the metal strip back onto itself at an end of the metal strip remote from the resilient region 67, which end is designed as a wire-fixing point 71 for connecting the contact tube 15 to an electric wire (not shown). The rigid region extends approximately at right angles to the contact tube longitudinal axis 59 and the resilient region 67 has a quarter-circle (i.e., 90 degree) bend 73 situated between the contact tube main part 19 and the rigid region 69.

In the embodiments illustrated in the drawings, an anchoring arm 75 is provided for fixing the contact tube 15 in a contact housing. The anchoring arm 75 extends approximately vertically away from the rigid region 69 so as to extend substantially parallel to the contact tube longitudinal axis 59. The anchoring arm 75 may be provided with two anchoring projections 77 for anchoring the anchoring arm 75 in a contact housing. The anchoring arm 75 may be formed by bending a free end of the folded-back part 79 of the two-layer rigid region 69 down at right angles to the two-layer rigid region 69.

At least a part of the individual contact touch zones 51, 53 and 55 may have one or more point- or line contact points, wherein the line contact points may extend in axial direction of the contact tube 15. FIG. 4 shows an embodiment, in which the first contact zone 51 has two point or line contact points 51*a* and 51*b*, which are situated at the two circumferential ends 31 and 33 of the contact tube main part 19.

Figure 5:
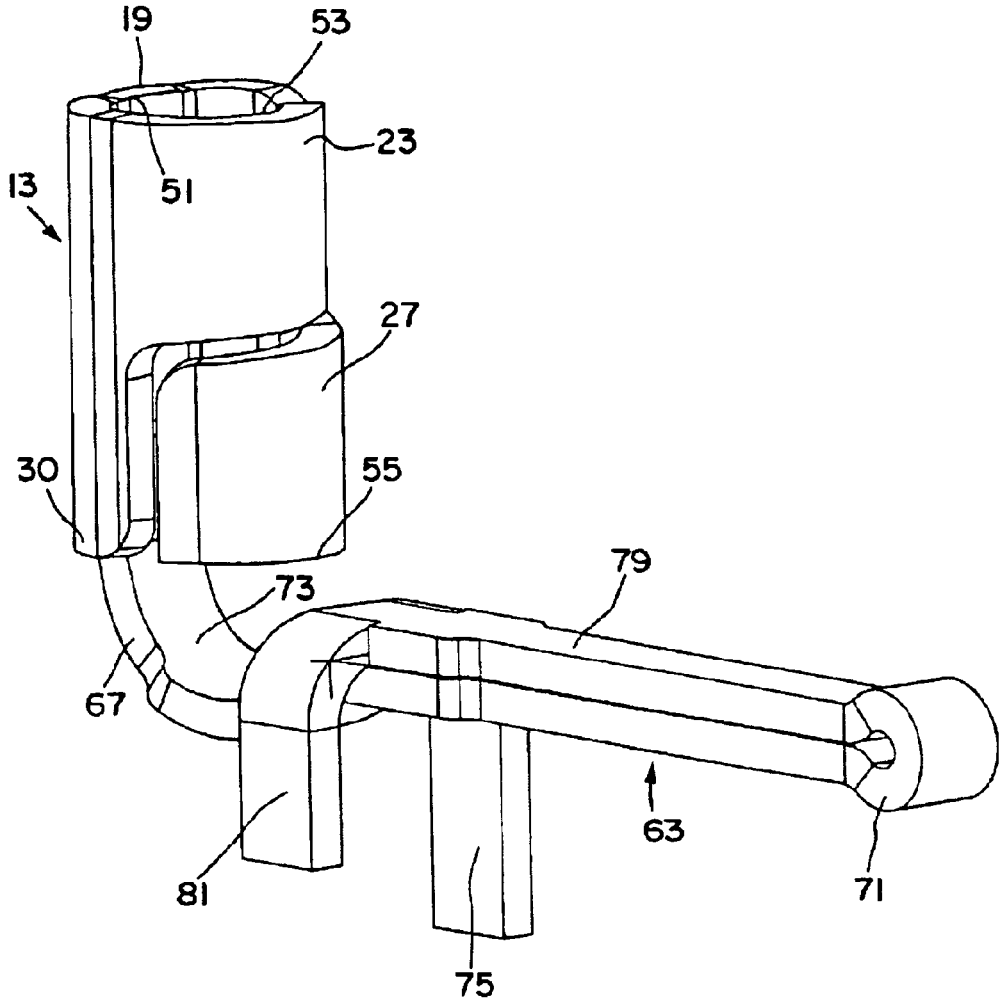
FIG. 5 is a perspective view of an alternative embodiment of a contact element according to the invention.
Figure 6:
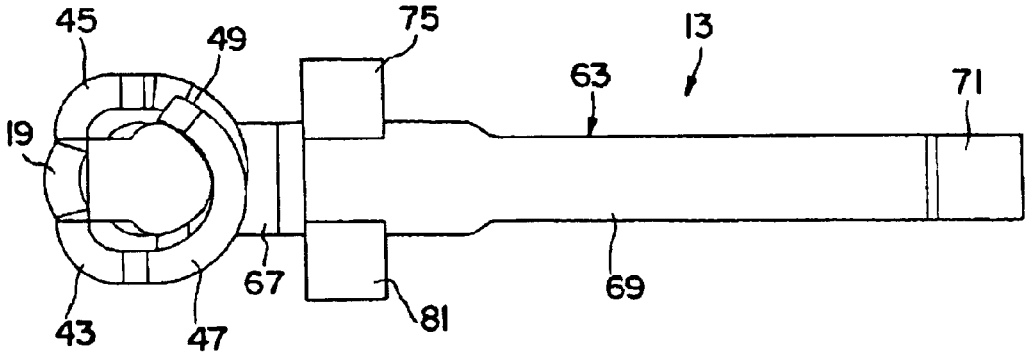
FIG. 6 is a plan view of the contact element of FIG. 5.

A alternative embodiment of a contact element 13 according to the invention is shown in FIGS. 5 and 6. This contact element differs from the first embodiment shown in FIGS. 1 to 4, because a fixing arm 81 is disposed on the rigid region 69 of the connecting arm 63, in addition to the anchoring arm 75. The fixing arm 81 extends from a longitudinal side of the two-layer rigid region 69 that lies opposite the longitudinal side, from which the anchoring arm 75 extends. Both the anchoring arm 75 and the fixing arm 81 are bent substantially at right angles down from the rigid region 69 such that they both extend substantially parallel to the contact tube longitudinal axis 59. The anchoring arm 75 and the fixing arm 81 may be connected either both to the same layer of the two-layer rigid region 69 or to different layers of the rigid region 69.

FIGS. 7 to 12 show a magnet coil arrangement with a contact housing 85, 86 and a plurality of contact elements 13 according to an exemplary embodiment invention.

Figure 7:
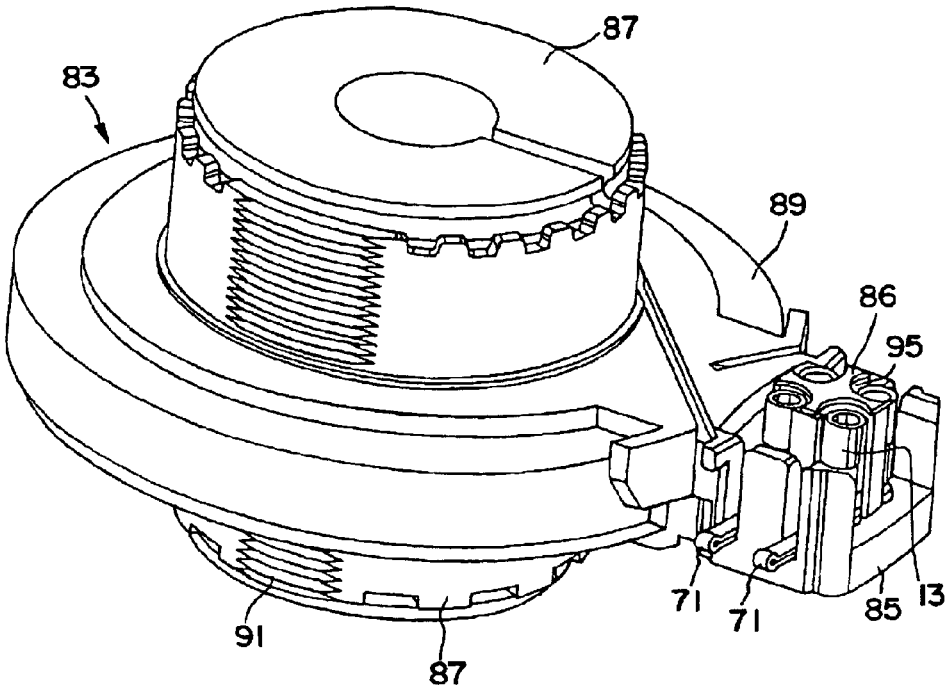
FIG. 7 is a perspective view of a magnet coil arrangement with a contact housing and a plurality of contact elements according to the invention.

FIG. 7 shows such a magnet coil arrangement 83 in a perspective view. The magnet coil arrangement 83 has two magnet coils 87 each comprising a coil form 89 and a coil winding 91 situated thereon. Disposed on the coil forms 89 is a contact carrier 85, onto which is mounted a chamber block 86, which is provided with (in the illustrated embodiment) four substantially cylindrical location chambers 95 for receiving in each case a contact tube 15 of a contact element 13 according to the invention.

The diameter of each location chamber 95 is selected to allow a predetermined extent of radial movement of the spring arms 23 and 27 of the contact tube 15 disposed in the location chamber 95. For each of the contact element location chambers 95 the chamber block 86 forms a mating-side stop 97 (FIG. 11) in the region of the mating-side axial end 25 and a terminal-side stop 99 in the region of the terminal-side axial end 29 of the respective contact tube 15 such that a predetermined axial mobility of the contact tube 15 in both axial directions is enabled but restricted to a predetermined maximum movement. The position of the stops 97 and 99 relative to the axial ends 25 and 29 is so selected that axially directed movements of the contact tube 15 as a result of a contact pin 17 inserted into the contact tube 15 remain unimpeded, provided they are caused by forces of motion below the axial forces needed to insert a contact pin 17 into the contact tube 15 or to remove the contact pin 17 from the contact tube 15. Thus, it is ensured on the one hand that the contact element 13 may absorb axial movements of the contact pin 17, which arise as a result of movements of the contact pin 17 of the type that are caused for example by vibrations in the surrounding area, but that the contact element 13 is protected from excessive loads.

As already mentioned, the location chambers 95 of the chamber block 86 have a substantially cylindrical shape of such a diameter that radial resilient movements of the spring arms 23 and 27 of the contact tube 15 are possible to a predetermined extent. Since in cooperation with the axial stops 97 and 99 axial resilient movements of the resilient region 67 of the connecting arm 63 of each contact element 13 are also allowed to a limited extent, the contact element 23 may absorb movements of the contact pin 17 in a three-dimensional manner and isolate them from the contact carrier 85 and the wire-fixing point 71 of the contact element 13, provided that the axially directed forces remain sufficiently below the forces needed to insert the contact pin 17 into the contact tube 15 or to remove the contact pin 17 from the contact tube 15.

Figure 8:
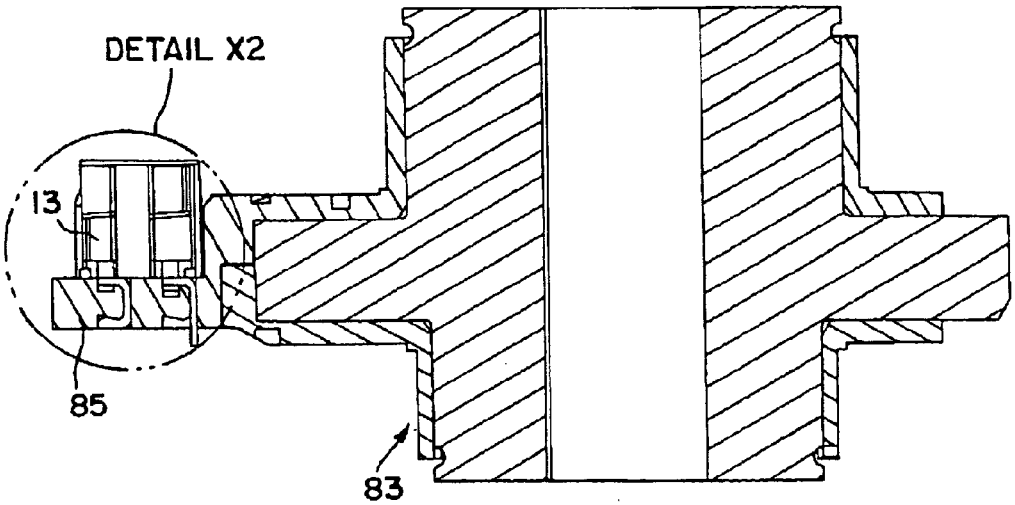
FIG. 8 is a longitudinal section of the magnet coil arrangement according to FIG. 7.

FIG. 8 shows a longitudinal section through the magnet coil arrangement 83 according to FIG. 7. The particularly relevant region of the contact carrier 85 and of the contact elements 13 disposed therein, which is characterised by "Detail X2" in FIG. 8, is shown to an enlarged scale in FIG. 9. There, two contact elements 13 are shown in two different assembly phases. In the case of the contact element 13 shown on the right in FIG. 9, the anchoring arm 75 extending parallel to the contact tube longitudinal axis 59 is merely inserted through an anchoring-arm through-channel 101 of the contact carrier 85 so as to project from the, in FIG. 9, bottom end of the anchoring-arm through-channel 101. In the case of the contact element 13 shown on the left in FIG. 9, the part of the anchoring arm 75 projecting from the bottom of the anchoring-arm through-channel 101 is bent approximately at right angles into a housing recess 103. The contact element 13 is therefore fixed to the contact carrier 85 both axially and radially relative to the contact tube longitudinal axis 59.

In the embodiment shown in FIG. 9, the contact carrier 85 has an upper sealing surface 85*a* and a lower sealing surface 85*b*, against which mould cores (not shown) are placed in a sealing manner during extrusion-coating with an encapsulating part (88 in FIG. 10), as will be explained in greater detail below.

Figure 10:
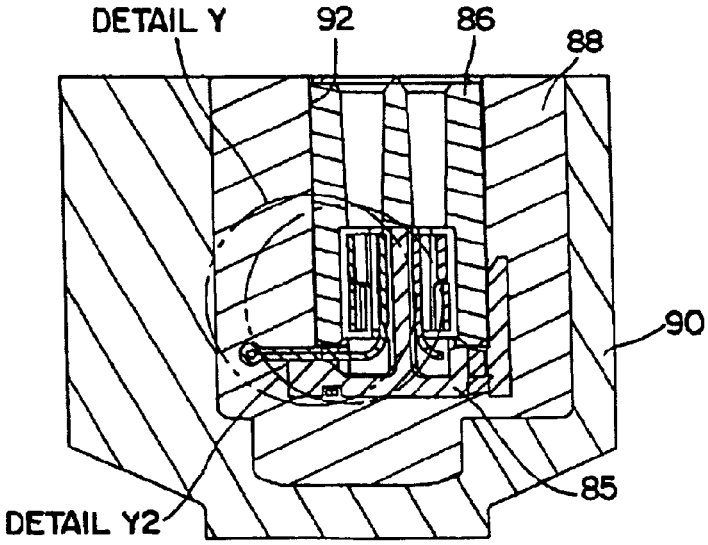
FIG. 10 is a detail view of the longitudinal section of FIG. 8.

FIG. 10 shows a sectional view of a housing arrangement comprising the contact carrier 85, the chamber block 86, the extruded encapsulating part 88 and an enclosure 90, wherein the connecting arm 63 of the left (as shown in FIG. 10) contact element 13 is shown in longitudinal section. In FIG. 10 two detail areas are characterised, one by "Detail Y" and the other by "Detail Y2". These two details are shown to an enlarged scale in FIG. 11 and FIG. 12 respectively.

Figure 9:
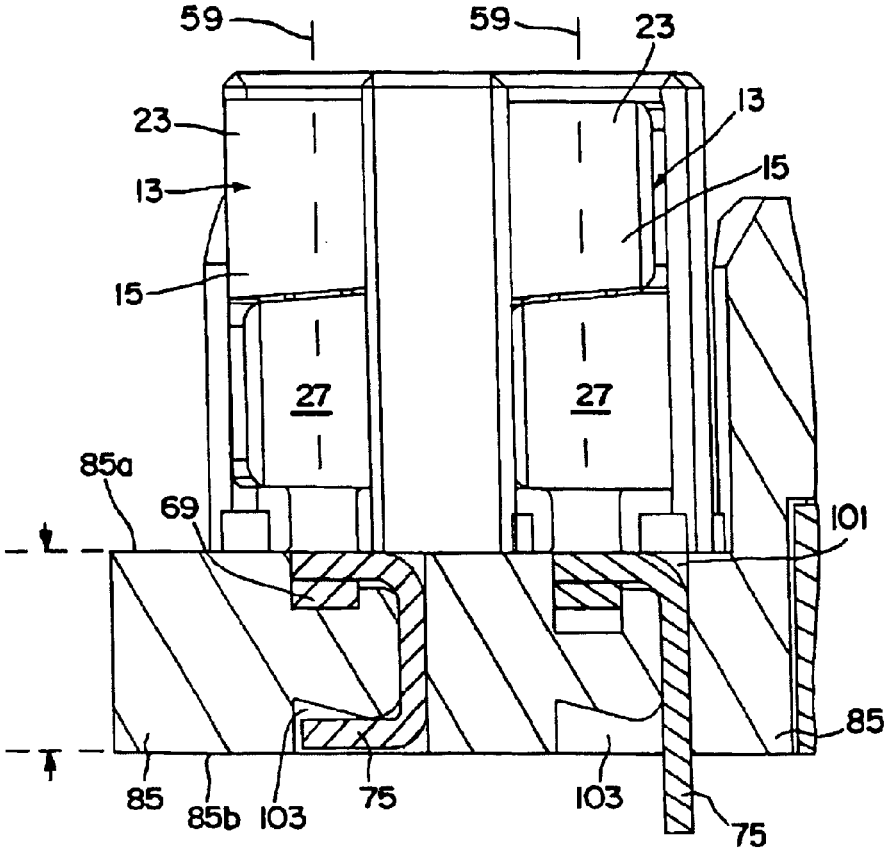
FIG. 9 is an enlarged view of a detail denoted by "X2" in FIG. 8.

FIGS. 9 and 10 show different manufacturing stages of a connector arrangement according to the invention. In the manufacturing stage shown in FIG. 9, the rigid regions 69 and anchoring arms 75 of the connecting arms 63 of the contact elements 13 are fixed in the contact carrier 85, while the contact tubes 15 stand up substantially free of the contact carrier 85. In the manufacturing stage shown in FIG. 10, the chamber block 86 is mounted onto the contact tubes 15 of the contact elements 13, the contact carrier 85 and the chamber block 86 are embedded in the extruded encapsulating part 88 and the extruded encapsulating part 88 is surrounded by the enclosure 90. In an exemplary embodiment, only the contact carrier 85 is injection-moulded into the extruded encapsulating part 88. After extrusion of the encapsulating part 88 onto the contact carrier 85, the chamber block 86 is inserted into a pocket 92 and mounted over the contact tubes 15, which are free-standing relative to the extruded encapsulating part 88. The pocket 92 is kept clear of extrusion material with the aid of mould cores (not shown) during extrusion of the encapsulating part 88.

In a method suitable for this purpose, first the chamber block 86 and the contact carrier 85 are provided, either by their direct manufacture or by procurement from an appropriate manufacturing establishment. Then, the connecting arms 63 of the contact elements 13 are fixed to the contact carrier 85 in such a way that the contact tubes 15 are held in a substantially free-standing manner, as shown in FIG. 9. In preparation for the process of extruding the encapsulating part 88, the previously mentioned mould cores are placed from above and below in a manner rendering the pocket 92 impervious to liquid extrusion material at sealing surfaces 85*a* and 85*b* of the contact carrier 85. The mould cores are of such a shape that during the extrusion process the pocket 92 for the chamber block 86 including the space for the contact tubes 15 of the contact elements 13 is kept clear of extrusion material. The contact carrier and the mould cores placed thereon are then extrusion-coated with plastics material. The mould cores are subsequently removed from the extruded encapsulating part 88 to leave behind the pocket 92. The chamber block 86 is then inserted into the pocket 92, wherein it is mounted over the contact tubes 15 of the contact elements 13. The chamber block 86 is formed in such a way that it allows a limited axial movement of the contact tubes 15.

Figure 11:
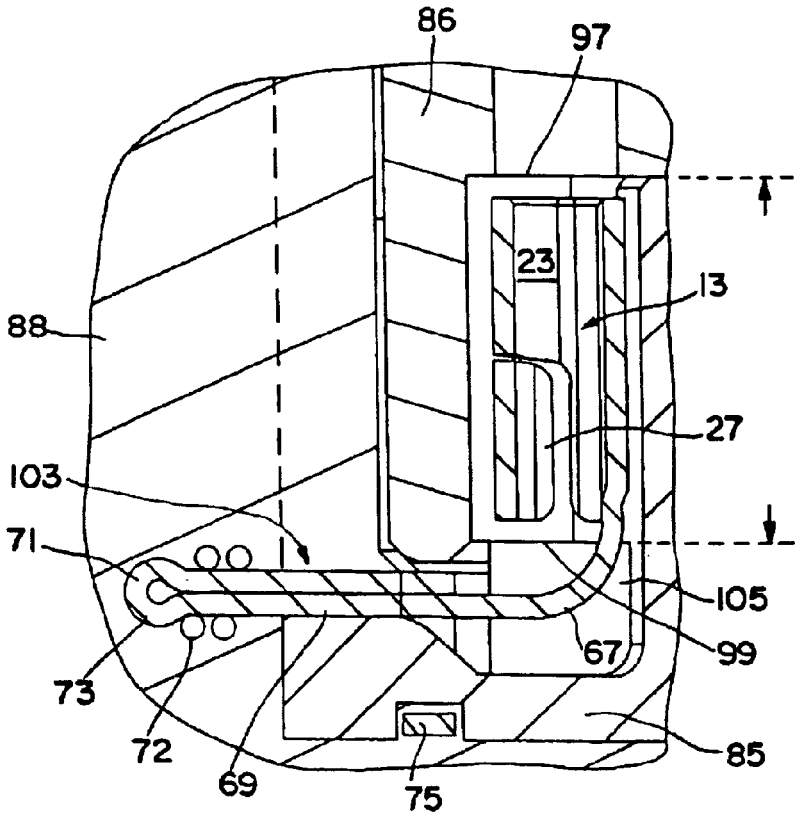
FIG. 11 is an enlarged view of a detail denoted by "Y" in FIG. 10.
Figure 12:
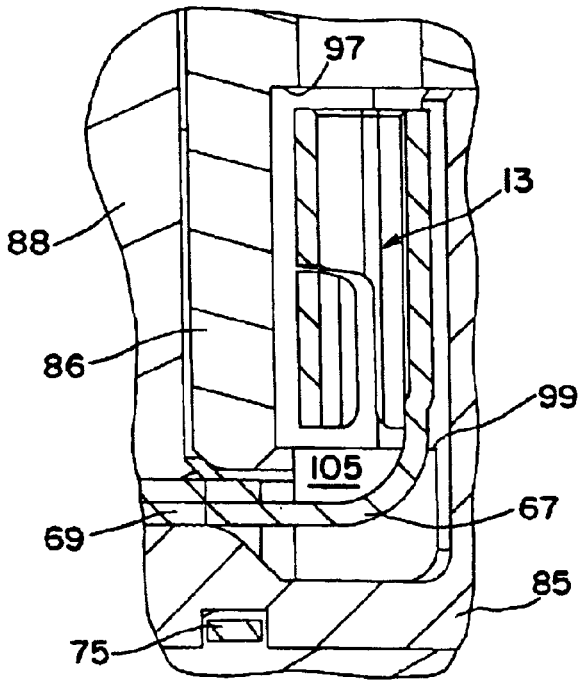
FIG. 12 is an enlarged view of a detail denoted by "Y2" in FIG. 10.

The detail view of FIG. 11 shows the rigid region 69 of the connecting arm 63, which rigid region extends through and is fixed in a housing slot 103 and has a wire wrapping 72 wound around it. Further shown is a plan view of a cross section of the bent anchoring arm 75. From FIGS. 11 and 12 it is also clearly evident that the resilient region 67 having a quarter-circle bend is situated in a housing cavity 105 and hence may in an unimpeded manner allow axial resilient movements of the contact tube 15, provided that these are not restricted by one of the two stops 97 and 99.

Figure 13:
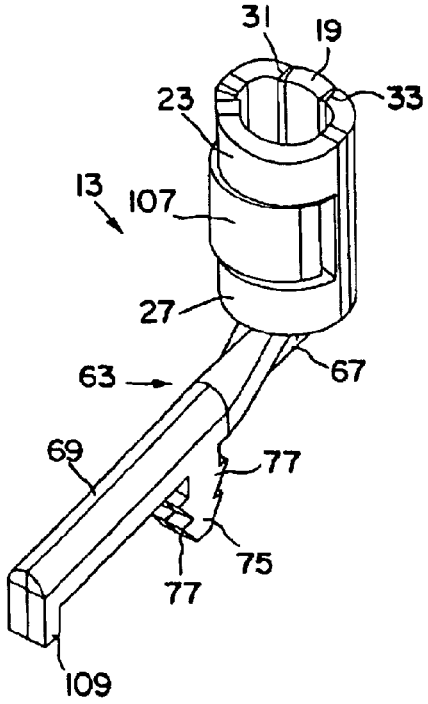
FIG. 13 is a perspective view of a third embodiment of a contact element according to the invention, which is provided with three spring arms.
Figure 14:
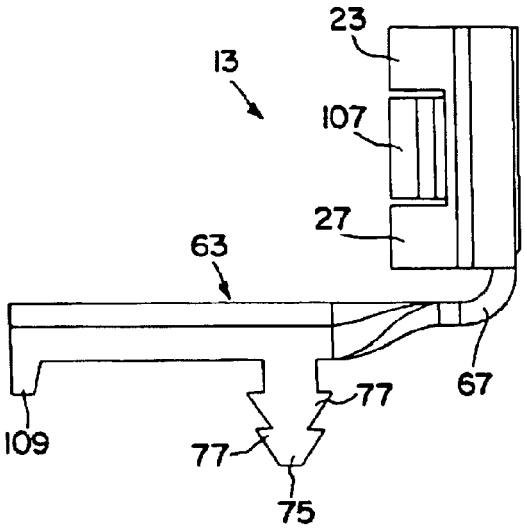
FIG. 14 is a first side view of the contact element of FIG. 13 from its, in FIG. 13, right side.
Figure 15:
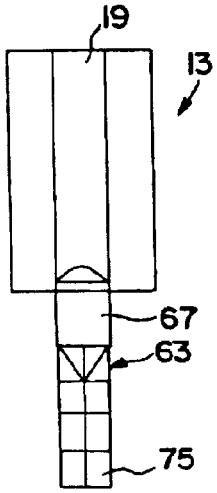
FIG. 15 is a second side view of the contact element of FIG. 13 from its, in FIG. 13, rear side.
Figure 16:
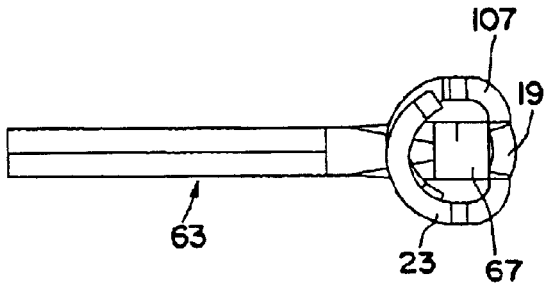
FIG. 16 is a plan view from above of the contact arrangement of FIG. 13.

FIGS. 13 to 15 show a third embodiment of a contact element 13 according to the invention, which differs from the contact elements 13 of FIGS. 1 to 5 in that it has, in addition to the mating-side spring arm 23 and the terminal-side spring arm 27, a third middle spring arm 107 and in that the rigid region 69 of the connecting arm 63 is of a different configuration. Unlike in the contact elements 13 of FIGS. 1 to 5, the two outer spring arms 23 and 27 extend from the same circumferential end 33 of the contact tube main part 19 and the middle spring arm 107 extends from the other circumferential end 31 of the contact tube main part 19. Otherwise, the spring arms 23, 27 and 107 are formed in precisely the same manner as the spring arms 23 and 27 of the contact elements 13 of FIGS. 1 to 5. The rigid region 69 serving as a wrapping post is formed by the folding of two sheet-metal layers, one alongside the other, instead of one on top of the other as in FIGS. 1 to 5. At the free end of rigid region 69 an offset wire-fixing point 109 is provided.

Approximate dimensions of an exemplary embodiment of a contact element 13 according to the invention and of a contact element location chamber 95 are provided in Table 1.

TABLE 1

| feature | dimension in millimeters |
|---|---|
| outside diameter contact tube cylinder 15 | 1.1–1.4 |
| inside diameter of contact tube cylinder 15 | 0.7–0.8 |
| play of contact tube cylinder 15 | 0.2 |
| outside diameter of contact pin 17 | 0.8 |
| location chamber inside diameter | 1.9–2.0 |
| total length of contact tube 15 | 6.1–6.2 |
| sheet metal thickness of contact element 13 | 0.2 |

The length of the contact element location chamber 95 is dependent upon the number of spring arms.

The contact element according to the invention meets the basic requirements of a jack that withstands a large number of plug-in operations. In an exemplary embodiment, the contact element is made of nickel silver and is capable of withstanding $10^9$ axial reciprocating movements of 20?m each, without resulting in perceptible wear of the contact element. The three-dimensional resilient compliance of the contact element according to the invention is moreover capable of isolating the contact housing and apparatuses connected to the contact element from forces that result from movements of a contact pin inserted into the contact element.

We claim:

1. A single-piece electrical contact element having a substantially cylindrical contact tube for resiliently receiving a substantially cylindrical contact pin, the contact tube comprising:

a contact tube main part, which extends over at least a substantial part of a length of the contact tube and over a first circumferential sub-region of a circumference of the contact tube, and at least one radially resilient spring arm, connected to one circumferential end of the contact tube main part and extending over a second circumferential sub-region of the contact tube circumference, wherein the spring arm projects radially outwardly in a first circumferential region adjacent to the contact tube main part and has a cylindrical free-standing circumferential end region, wherein the contact pin inserted into the contact tube only contacts the contact tube at a first contact touch zone at the contact tube main part and at a second contact touch zone at the free-standing end region of the spring arm.

2. The contact element according to claim 1, in which the second circumferential sub-region of the contact tube is substantially larger than the first circumferential sub-region thereof.

3. The contact element according to claim 1, wherein the spring arm has an approximately spiral cross-sectional shape, wherein a spiral start adjacent to the contact tube main part is at a greater radial distance from the contact tube longitudinal axis than a free-standing spiral end and a center of curvature of the spiral start is offset radially outwards relative to a longitudinal axis of the contact tube.

4. The contact element according to claim 1, wherein the free standing end region of the spring arm provided for the resilient second contact touch zone is at a circumferential distance from the contact tube main part corresponding to approximately ⅔ of the contact tube circumference.

5. The contact element according to claim 1, wherein at least two radially resilient spring arms are offset from one another in an axial direction of the contact tube and movable independently of one another, the spring arms being connected to opposite circumferential ends of the contact tube main part and extending in opposite circumferential directions over second circumferential sub-regions of the contact tube circumference, each spring arm projecting radially outwardly in a first circumferential region adjacent to the contact tube main part and having a cylindrical free-standing circumferential end region, whereby the contact pin inserted into the contact tube contacts the contact tube at three contact touch zones, a first contact touch zone in the region of the contact tube main part and at least two resilient further contact touch zones in the free-standing end regions of the at least two spring arms.

6. The contact element according to claim 1, wherein at least one of the contact touch zones forms, in the circumferential direction of the contact tube, one or more point-contacts or line contacts.

7. The contact element according to one of claim 1, further comprising a connecting arm integrally connected to the contact tube, which connecting arm is connected to an end region of the contact tube main part remote from a mating end of the contact tube and is configured to enable a resilient axial movement of the contact tube.

8. The contact element according to claim 7, wherein the connecting arm comprises a resilient region adjacent to the contact tube main part and a rigid region adjoining the resilient region and being more rigid than the resilient region.

9. The contact element according to claim 8, wherein the connecting arm is formed by a metal strip, the resilient region of which is formed by a single-layer portion of the metal strip and the rigid region of which is formed by a two-layer portion of the metal strip.

10. The contact element according to claim 9, wherein the rigid region is formed by folding the metal strip back onto itself at an end of the metal strip remote from the resilient region.

11. The contact element according to claim 8, wherein the rigid region, at an end region thereof remote from the resilient region, is configured as a contact for connecting the contact tube to an electric wire.

12. The contact element according to claim 8, wherein the rigid region extends approximately at right angles to the contact tube longitudinal axis and the resilient region has a quarter-circle bend between the contact tube main part and the rigid region.

13. The contact element according to claim 8, further comprising an anchoring arm for fixing the contact tube in a contact housing, the anchoring arm extending approximately at right angles away from the rigid region.

14. The contact element according to claim 13, wherein the anchoring arm extends in a direction running parallel to the contact tube longitudinal axis.

15. The contact element according to claim 13, wherein the anchoring arm has at least one anchoring projection for anchoring the anchoring arm in the contact housing.

16. The contact element according to claim 13, wherein the connecting arm is formed by a metal strip, the resilient region of which is formed by a single-layer portion of the metal strip and the rigid region of which is formed by a two-layer portion of the metal strip folded back onto itself, wherein the anchoring arm is formed by bending a free end of the folded-back part of the two-layer rigid region down at right angles to the two-layer rigid region.

17. The contact element according to 8, further comprising a fixing arm disposed on the rigid region of the connecting arm.

18. The contact element according to claim 17, further comprising an anchoring arm for fixing the contact tube in a contact housing, wherein the anchoring arm and the fixing arm are integrally connected each to one of the two double layers of the rigid region.

19. A connector arrangement having at least one single-piece electrical contact element and a contact housing, the contact element having a substantially cylindrical contact tube for resiliently receiving a substantially cylindrical contact pin, the contact tube comprising a contact tube main part, which extends over at least a substantial part of a length of the contact tube and over a first circumferential sub-region of a circumference of the contact tube, and at least one radially resilient spring arm, connected to one circumferential end of the contact tube main part and extending over a second circumferential sub-region of the contact tube circumference, wherein the spring arm projects radially outwardly in a first circumferential region adjacent to the contact tube main part and has a cylindrical free-standing circumferential end region, the contact housing being configured to receive the contact element and having at least one substantially cylindrical location chamber with a diameter that allows a predetermined extent of radial movement of the at least one spring arm of the contact tube, wherein the contact housing has a stop approximately in the region of each of the two axial end regions of the contact tube, such that a predetermined axial mobility of the contact tube in both axial directions is enabled but restricted to a predetermined maximum movement.

20. A connector arrangement according to claim 19, wherein the contact housing is of a multi-part design and comprises a contact carrier which supports the at least one contact element, and a chamber block having at least one location chamber.

21. Connector arrangement according to claim 20, in which the contact housing is surrounded by an extruded encapsulating part, wherein the contact carrier is injection-moulded into the extruded encapsulating part, while the chamber block is inserted into a pocket of the extruded encapsulating part.

22. A connector arrangement having at least one contact element and a contact housing, the contact element having a substantially cylindrical contact tube for resiliently receiving a substantially cylindrical contact pin and an anchoring arm for fixing the contact tube in the contact housing, the contact tube comprising a contact tube main part, which extends over at least a substantial part of a length of the contact tube and over a first circumferential sub-region of a circumference of the contact tube, and at least one radially resilient spring arm, connected to one circumferential end of the contact tube main part and extending over a second circumferential sub-region of the contact tube circumference, wherein the spring arm projects radially outwardly in a first circumferential region adjacent to the contact tube main part and has a cylindrical free-standing circumferential end region, the contact housing being configured to receive the contact element and having at least one substantially cylindrical location chamber with a diameter which allows a predetermined extent of radial movement of the at least one spring arm of the contact tube, wherein the contact housing has a stop approximately in the region of each of the two axial end regions of the contact tube, such that a predetermined axial mobility of the contact tube in both axial directions is enabled but restricted to a predetermined maximum movement, the contact housing having an anchoring-arm through-channel for receiving the anchoring arm, wherein an end region of the anchoring-arm through-channel is offset such that the contact element is fixed in axial direction of the contact tube.

* * * * *